US005870119A

United States Patent [19]

Chen et al.

[11] Patent Number: 5,870,119

[45] Date of Patent: Feb. 9, 1999

[54] PRINT-CARTRIDGE CARRIAGE

[75] Inventors: Ying-Chic Chen, Kuan-Hsi Town; Jiuun-Hwa Horng, Hsin Chu, both of Taiwan

[73] Assignee: Industrial Technology Research Institute, Hsinchu, Taiwan

[21] Appl. No.: 641,801

[22] Filed: May 2, 1996

[51] Int. Cl.[6] ..... B41J 2/175

[52] U.S. Cl. ..... 347/49; 347/50

[58] Field of Search ..... 347/49, 50; 439/347, 439/372, 352

[56] References Cited

U.S. PATENT DOCUMENTS

| | | | |
|---|---|---|---|
| 4,755,836 | 7/1988 | Ta et al. | 346/140 R |
| 4,907,018 | 3/1990 | Pinkerpell et al. | 346/139 R |
| 5,558,534 | 9/1996 | Sarkady et al. | 439/352 |
| 5,588,862 | 12/1996 | Perkins et al. | 439/347 |

*Primary Examiner*—Benjamin R. Fuller
*Assistant Examiner*—Christina Annick
*Attorney, Agent, or Firm*—W. Wayne Liauh

[57] ABSTRACT

An improved print-cartridge carriage for ink-jet printers. It contains: (a) a carriage frame having a first recess, a second recess, a pair of spaced L-shaped, and a bearing allowing the carriage frame to be horizontally movable; (b) a gripping spring disposed in the first recess; (c) a pair of spring loaded buttons disposed in the second recess, each of spring loaded buttons has a first bevel surface; and (d) a gripping member having two symmetrically lateral second bevel surfaces. Each of the second bevel surfaces is slidably and respectively engageable with one of the first bevel surface such that the gripping member can be moved relating to the spring loaded buttons and be lifted upwardly when the spring loaded buttons are pressed inwardly. The gripping member further includes a protruded stud formed on a top location of the gripping member of upward engagement with the gripping spring, and an outwardly projecting latch formed on a bottom location of the gripping member for holding a ledge of a print cartridge by a downwardly gripping force provided by the gripping spring.

5 Claims, 6 Drawing Sheets

PRINT-CARTRIDGE CARRIAGE

BACKGROUND OF THE INVENTION

1. Field of the Invention

This invention relates to an improved print-cartridge carriage for holding a print cartridge which has a ledge on a top edge and a plurality of contact pads on a lateral wall for use in ink-jet printers, and, more particularly, to an improved print-carriage in which the print cartridge can be easily removed using only one hand of the user.

2. Description of the Prior Art

In thermal ink-jet printers of the type that use heat to produce air bubbles in order to expel ink-droplets through the nozzles thereof, the print cartridge and the cartridge thereof are typically manufactured in separate integral structures, in that it is desirable that the print cartridge be designed as a disposable cartridge, due to its limited life span.

FIGS. 1 and 3 illustrates a print-cartridge carriage (A) for mounting a print cartridge (B) which is disclosed in U.S. Pat. No. 4,907,018, to Pineapple's et al. FIG. 2 illustrates the structure of a print cartridge (B), which is already disclosed in U.S. Pat. No. 4,755,836, to Ta et al. The print-cartridge carriage of the Pinkerpell's disclosure includes a base support (C), which has a snap-spring (X) disposed at the upper portion thereof and a pair of L-shaped members (D) disposed at the lower portion thereof. The base support further has an interconnect strip (E) which has a plurality of electrically conducting lines (F) built therein for transferring electrical signal generated by a microprocessor, wherein each conducting line (F) terminates on a spring pad (G) provided at the carriage. The base support also includes a bearing (H) for being engaged with a carriage rod of the printer for permitting the carriage to be horizontally movable (not shown in the drawings).

FIG. 2 is a perspective view of the print cartridge (B), which includes a ledge (1) and a reference pad (J). The bottom of the carriage is provided with a printhead (K) which has a plurality of nozzles formed therein, through which the ink droplet may inject out onto paper sheets by the heating of specific resisters. The back of the print cartridge (B) is provided with a contact strip (L), which has a plurality of contact pads (M) formed thereon to be engageable with the terminals of the electrically conducting lines of the interconnect strip (E), for transferring electrical signal generated by the microprocessor to the print cartridge, which will cause specific resistors associated with the nozzles to be heated so as to control the injection of the ink-droplets to produce a desired print pattern.

As illustrated in FIG. 1, a user may take the reference pad (J) of the print cartridge (B) of the type to be pivotally rested on the L-shaped members (D) to allow the print cartridge (B) to turn about the L-shaped members (D), as showed by arrow-head P1, such that the print cartridge (B) can be locked onto the base support (C) of the carriage (A) by the engagement of the ledge (I) and the snap spring (X). Reversely, the print cartridge (B) may be removed from the base support (C), by applying a moment, the direction of which is reverse to P1.

Although such a carriage allows the ink-jet printers to be used easily by the user, yet the process of removing the print cartridge would require a relatively large force and great care to remove it from the carriage (A) and to avoid the dropping of the print cartridge. As can be seen in some other embodiments, the carriages are further provided with chutes, respectively, to prevent the print cartridge (B) from dropping to the ground.

SUMMARY OF THE INVENTION

It is an object of the present invention to provide a print cartridge carriage to allow a print cartridge to be easily removed therefrom and can also avoids the dropping of the print cartridge during the removing process.

DETAILED DESCRIPTION

Figure 4:
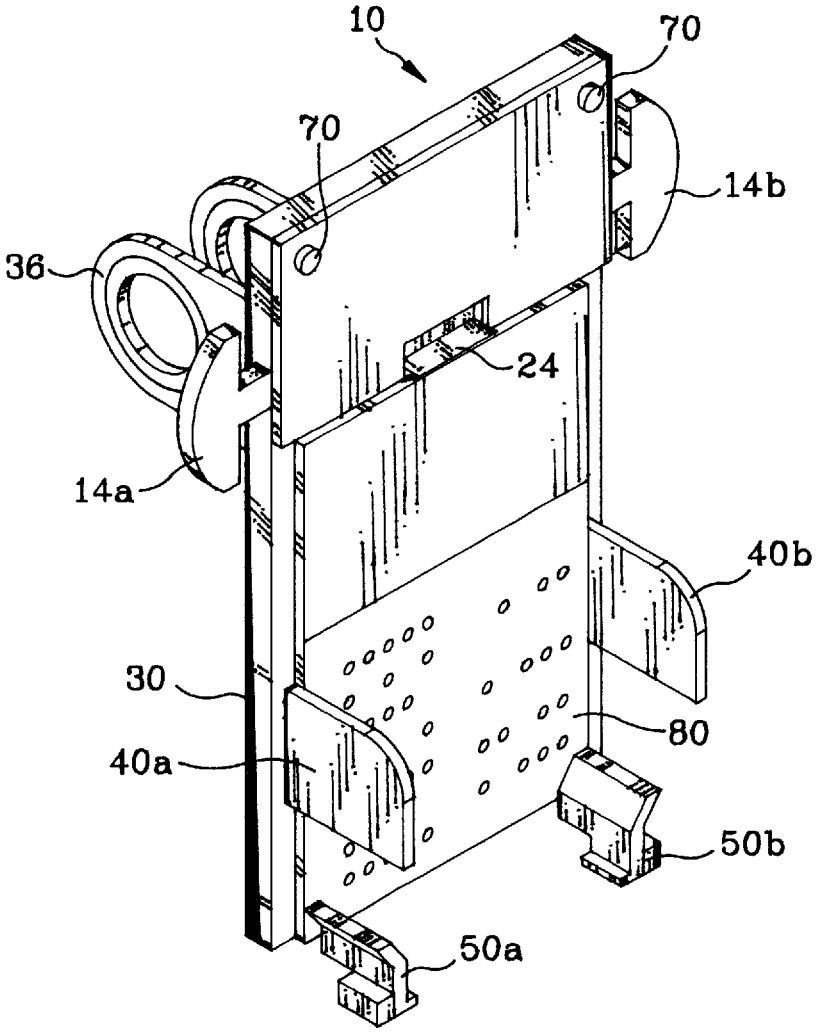
FIG. 4 is a perspective view of the print-cartridge of the present invention.
Figure 5:
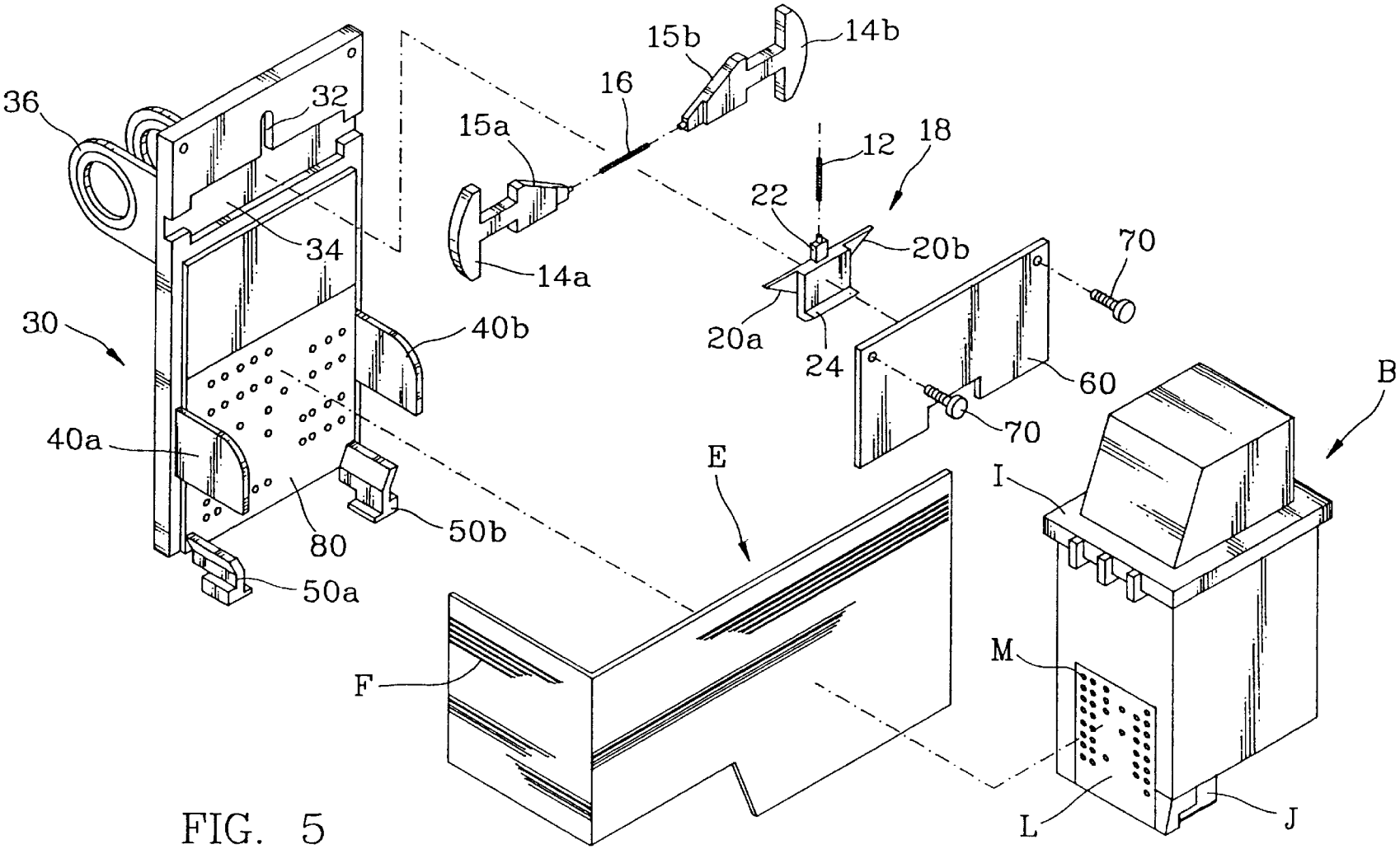
FIG. 5 is an exploded view of the print-cartridge carriage of the present invention.

Referring to FIGS. 4 and 5, the print-cartridge carriage (10) of the present invention includes a gripping spring (12); a pair of spring loaded buttons (14*a*), (14*b*), each of which respectively has a bevel surface (15*a*), (15*b*). The spring loaded buttons 14*a* and 14*b* has a compression spring (16) located therebetween. As shown in FIG. 5, the compression spring (16) forces each button to move outwardly when no external force is present (14*a*), (14*b*).

Figure 1:
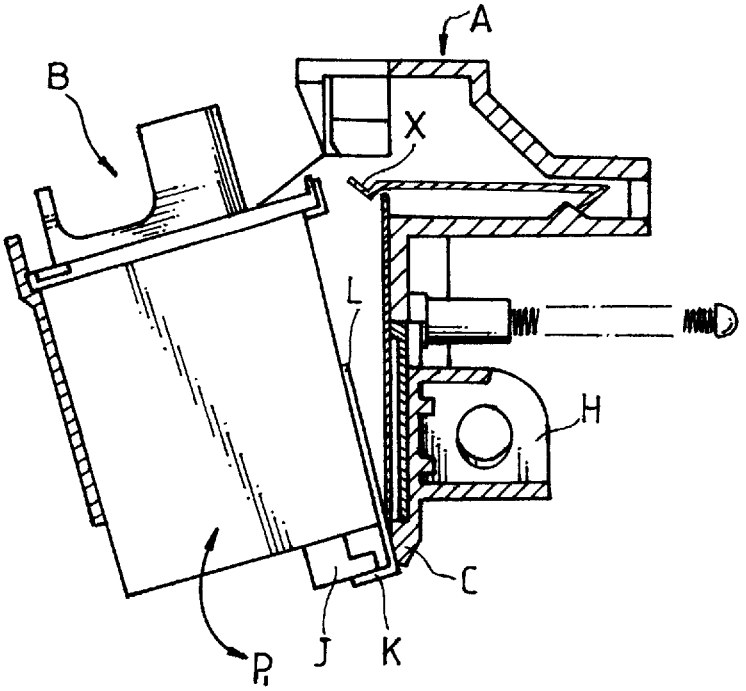
FIG. 1 (Prior Art)
FIG. 1 is a side elevation view of a conventional print cartridge and carriage assembly.
Figure 2:
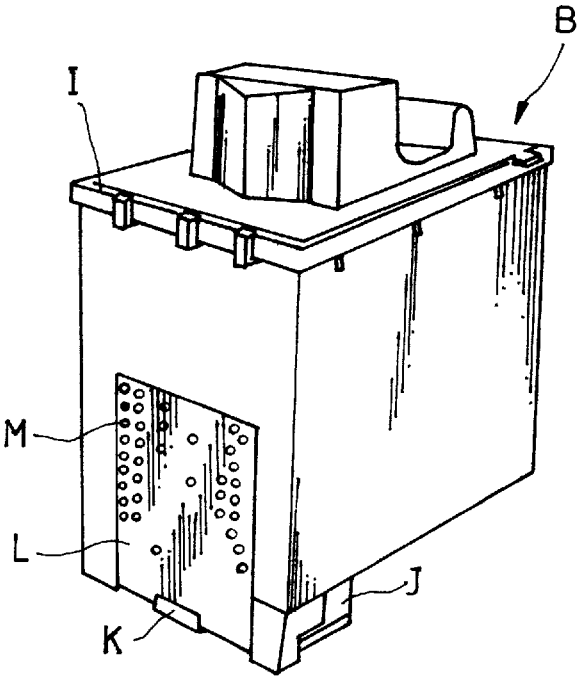
FIG. 2 (Prior Art)
FIG. 2 is a perspective view of the print cartridge of the conventional type.

The print cartridge (B) for this invention is generally constructed like the one shown in FIG. 2 with a ledge (I) at a top edge a reference pad (J) at the bottom, and a contact strip (L) on the back. The contact strip (L) has a plurality of contact pads (M) located on a lateral wall.

A gripping member (18) is provided which has two lateral bevel surfaces (20*a*), (20*b*) for matching respectively with the bevel surfaces (15*a*), (15*b*). The gripping member (18) further has a protruded stud (22) on the top thereof to engage with the gripping spring (12), and an outwardly projecting latch (24) at the bottom thereof for engaging with the ledge (I) of the print cartridge (please refer to FIG. 2). A carriage frame (30) is provided which has: a first recess (32) for receiving the gripping spring (12), a second recess (34) for receiving the spring loaded buttons (14*a*), (14*b*); a pair of spaced support brackets (40*a*), (40*b*); a pair of spaced L-shaped member (50*a*) (50*b*) disposed at the bottom portion of the carriage frame (30); and a bearing (36) provided at the back of the carriage frame (30) for slidable engagement with a carriage rod of the printer (not shown in the drawings) to allow the carriage to be horizontally movable along the carriage rod.

Figure 6:
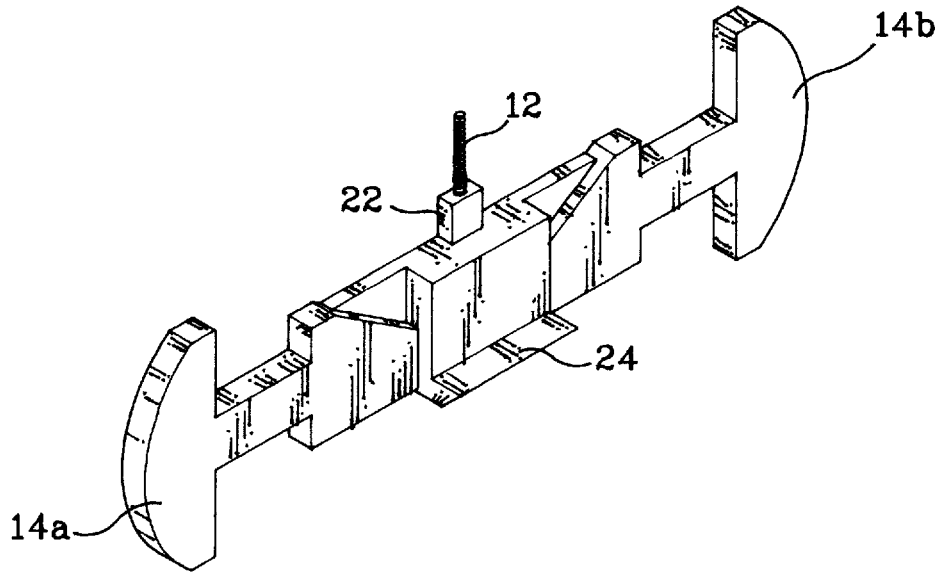
FIG. 6 is a fragmentary perspective view of the print-cartridge carriage of the present invention.
Figure 7:
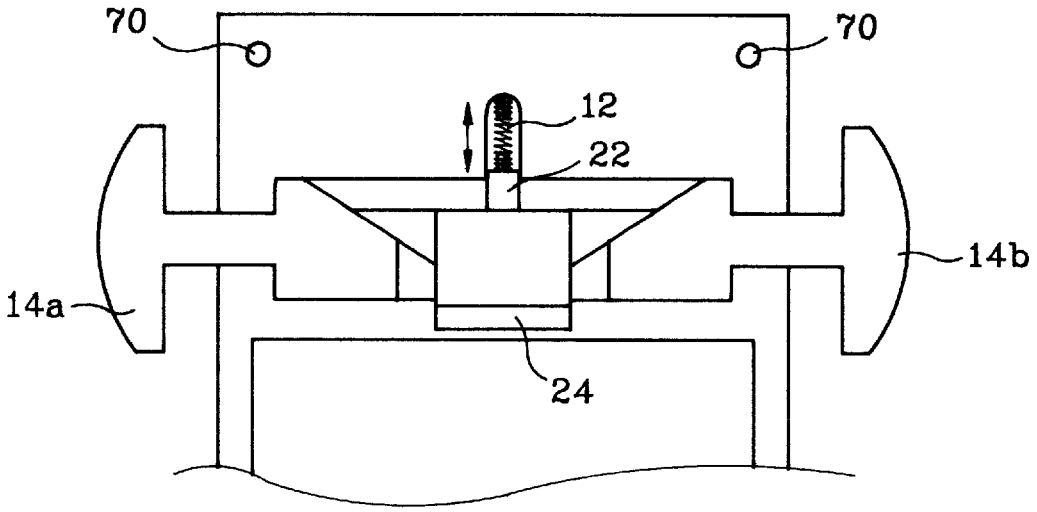
FIG. 7 is a fragmentary front view of FIG. 6, in which the cover is taken out of the carriage frame.

The first recess (32) is formed perpendicular with the second recess (34). As shown in FIG. 6 and FIG. 7, the gripping spring (12) can exert a downward force to the protruded stud (22) of the gripping member (18), which in turn will cause the outwardly projecting latch (24) of the gripping member to hold the ledge (I) of the print cartridge (B). The bevel surfaces (15*a*), (15*b*) of the spring loaded button (14*a*), (14*b*) are slidably engageable with the bevel surface (20*a*), (20*b*) of the gripping member (18), respectively. As the user presses the spring loaded buttons (14*a*), (14*b*) inwardly, the gripping member (18) will be lifted upwardly to unlock the print cartridge (B). Upon releasing the pressing force, the compression spring (18) will push the spring loaded button (14*a*), (14*b*) outwardly, and thus back to its original position, therefore the gripping spring (12) will force the gripping member (18) to move downwardly in order to lock the print cartridge.

As shown in FIG. 5 and 6, the carriage of the present invention can be further provided with a pair of support brackets (40*a*), (40*b*) to laterally support the print cartridge to further secure the mounting of the print cartridge (B). A cover (60), which can be mounted on the carriage frame (30) by using a fastening means, such as screws, can combine the mechanical elements, namely, the gripping spring (12), the gripping member (18), and the spring loaded buttons (14*a*), (14*b*) to form an integral mechanical combination to allow the mechanical elements therein to cooperate with each other in order to achieve the purpose of this invention, as described above.

Figure 3:
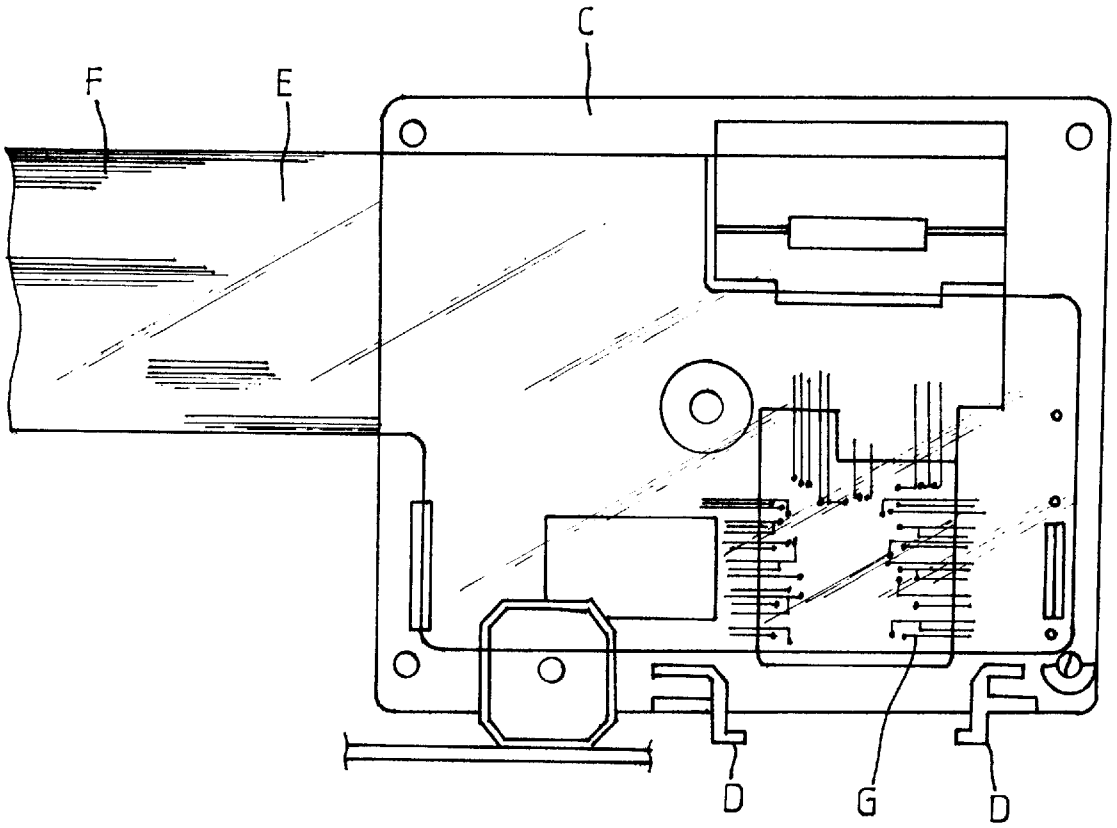
FIG. 3 (Prior Art)
FIG. 3 is a front elevation view of the conventional print cartridge carriage.

On the front lower portion of the carriage frame (30) is provided with an interconnect strip (E) which is generally constructed like the one shown in FIG. 3 and which has a plurality of electrically conducting lines (F) therein for transferring electrical signal from a microprocessor (not shown), wherein the terminals (80) of the electrically conducting lines (F) are configured to be engageable with the contact pads (M) of the contact strip (L) provided on the print cartridge (B), such that the electrical signal generated by the microprocessor may be transferred to the print cartridge (B) to control the injection of the ink-droplet.

Figure 8:
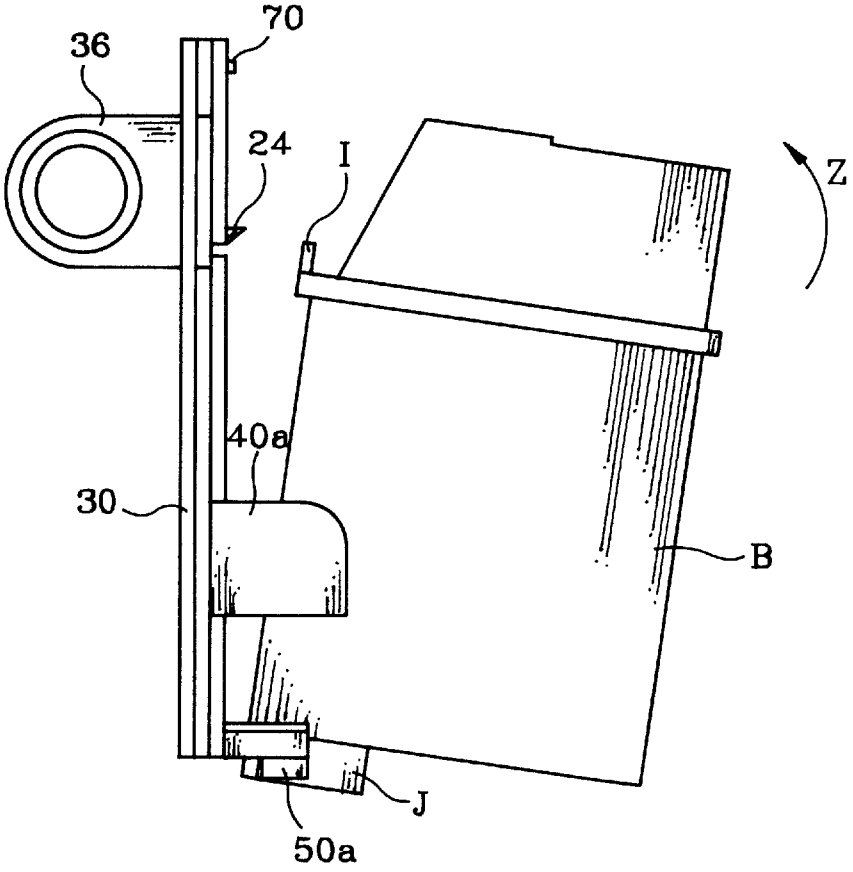
FIG. 8 is a side elevation view of the conventional print cartridge engaging with the print-cartridge carriage of the present invention.

In the installing process of the print cartridge (B) (as shown in FIG. 8), the user may take the print cartridge (B), simply by the thumb and the forefinger of a hand, to place the reference pad (J) thereof onto the L-shaped members (50*a*) (50*b*), then turn the print cartridge (B) about the L-shaped member (50*a*) (50*b*), which is functioned as a pivot, as shown by the arrowhead Z, to have the ledge (1) of the print cartridge (B) snapped to the outwardly protruded latch (24) of the gripping member (18), and to have the contact pads (M) of the print cartridge in electrical contact with the terminal (80) of the carriage frame (30), thereby forming a electrical connection between the microprocessor and the print cartridge, as described above.

Concerning the process of removing the print cartridge, a user may use his thumb and forefinger to press the spring loaded buttons (14*a*), (14*b*) inwardly and simultaneously, which allow the spring loaded buttons (14*a*), (14*b*) to move toward each other, thereby making the gripping member (18) lifted upwardly by the relative sliding movement between the bevel surface (15*a*) (15*b*) of the button and the bevel surface (20*a*) (20*b*) of the gripping member (18), to overcome the downward force of the gripping spring (12), so that the print cartridge (B) will be released from the carriage (10) and thus may naturally fall down into the palm of the user, therefore preventing the print cartridge from falling down to the ground caused by the carelessness of the user.

In summary, the present invention has the following advantages:

1. It can be operated easily with small force. It is ergonomically structured and user friendly.

2. It can prevent the print cartridge from dropping during the removing and replacing operation.

Although the present invention has been described and illustrated relative to a preferred embodiment thereof and a preferred use therefore, it is not to be so limited since changes and modifications can be made therein which are within the fill intended scope of the invention.

We claim:

1. A print-cartridge carriage for use in an ink-jet printer having a print cartridge which includes a ledge on a top edge and a plurality of contact pads on a lateral wall, comprising:

a carriage frame having a first recess, a second recess, a pair of spaced L-shaped members, a plurality of terminals and a bearing allowing said carriage frame to be horizontally movable;

a gripping spring disposed in said first recess;

a pair of spring loaded buttons disposed in said second recess, each of said spring loaded buttons has a first bevel surface;

a gripping members located in said second recess having two symmetrically lateral second bevel surfaces, each of said second bevel surfaces is slidably and respectively engaged with one of said first bevel surfaces provided in said spring loaded buttons, such that said gripping member can be moved relative to said spring loaded buttons and be lifted upwardly when said spring loaded buttons are pressed inwardly for releasing said print cartridge, said gripping member further having: a protruded stud formed on a top location of said gripping member for upward engagement with said gripping spring, and an outwardly projected latch formed on a bottom location of said gripping member for holding a ledge of said print cartridge by a downwardly gripping force provided by said gripping spring;

a cover engageable to said carriage frame in front of said first and second recesses;

means for fastening said cover to said carriage frame; and an interconnect strip having a plurality of electrically conducting lines connectable to said terminals in said carriage frame respectively said terminals being engageable with said contact pads provided on said print cartridge for transferring electrical signals, to said print cartridge to control an injection of ink-droplet.

2. The print-cartridge of claim 1, wherein said spring loaded buttons are provided with a compression spring therebetween to allow each button to be returnable.

3. The print-cartridge carriage of claim 1, wherein said fastening means comprises at least one screw.

4. The print-cartridge of claim 1, wherein said carriage frame further comprises a pair of spaced lateral support brackets to laterally support said print cartridge therebetween.

5. A print-cartridge carriage for use in an ink-jet printer having a print cartridge carriage which includes a ledge on a top edge and a plurality of contact pads on a lateral wall, comprising;

a carriage frame having a first recess, a second recess, a pair of spaced L-shaped members, a plurality of terminals, and a bearing allowing said carriage frame to be horizontally movable;

a gripping spring disposed in said first recess;

a pair of spring loaded buttons disposed in said second recess, each of said spring loaded buttons has a first bevel surface;

a gripping member located in said second recess having two symmetrically lateral second bevel surfaces, each of said second bevel surfaces is slidably and respectively engageable with one of said first bevel surfaces provided in said spring loaded buttons such that said gripping member can be moved relative to said spring loaded buttons and be lifted upwardly when said spring loaded buttons are pressed inwardly, for releasing the print cartridge said gripping member further having: a protruded stud formed on a top location of said gripping member for upward engagement with said gripping spring, and an outwardly projecting latch formed on a bottom location of said gripping member for holding said ledge of said print cartridge by a downwardly gripping force provided by said gripping spring.

* * * * *